US009832556B2

(12) United States Patent
Akino

(10) Patent No.: US 9,832,556 B2
(45) Date of Patent: Nov. 28, 2017

(54) MICROPHONE DEVICE AND MICROPHONE STAND

(71) Applicant: KABUSHIKI KAISHA AUDIO-TECHNICA, Machida-shi, Tokyo (JP)

(72) Inventor: Hiroshi Akino, Machida (JP)

(73) Assignee: KABUSHIKI KAISHA AUDIO-TECHNICA, Machida-shi, Tokyo (JP)

( * ) Notice: Subject to any disclaimer, the term of this patent is extended or adjusted under 35 U.S.C. 154(b) by 0 days.

(21) Appl. No.: 15/178,728

(22) Filed: Jun. 10, 2016

(65) Prior Publication Data

US 2016/0373845 A1 Dec. 22, 2016

(30) Foreign Application Priority Data

Jun. 22, 2015 (JP) ..... 2015-124567

(51) Int. Cl.

| | |
|---|---|
| ***H04R 1/04*** | (2006.01) |
| ***H04R 1/08*** | (2006.01) |
| ***H01R 13/187*** | (2006.01) |
| *H01R 13/627* | (2006.01) |
| *H01R 24/76* | (2011.01) |

(52) U.S. Cl.

CPC ..... *H04R 1/04* (2013.01); *H01R 13/187* (2013.01); *H04R 1/08* (2013.01); *H01R 13/6277* (2013.01); *H01R 24/76* (2013.01); *H04R 2201/025* (2013.01)

(58) Field of Classification Search

CPC .. H01R 13/187; H01R 13/6277; H01R 24/76; H04R 1/04; H04R 1/08; H04R 2201/025

See application file for complete search history.

(56) References Cited

U.S. PATENT DOCUMENTS 3,140,342 A * 7/1964 Avery ..... F16J 15/06 174/356
6,128,385 A * 10/2000 Goyal ..... H04M 1/03 381/355

FOREIGN PATENT DOCUMENTS

JP 4686410 B2 5/2011

* cited by examiner

*Primary Examiner* — Brian Ensey
(74) *Attorney, Agent, or Firm* — Manabu Kanesaka

(57) ABSTRACT

There are provided a microphone stand having a connector supporting groove, and a microphone body supported by the microphone stand as a result of insertion of a connector case into the connector supporting groove. A resilient conductive cloth which comes into contact with the connector case is arranged in the connector supporting groove, with the connector case inserted in the connector supporting groove. The conductive cloth is preferably arranged in a ring shape along a lower bottom portion of the annularly formed connector supporting groove. This configuration mitigates rattling generated between the connector supporting groove and the connector case, thereby suppressing generation of a vibration noise due to microphone shaking.

10 Claims, 6 Drawing Sheets

MICROPHONE DEVICE AND MICROPHONE STAND

RELATED APPLICATIONS

The present application is based on, and claims priority from, Japanese Application No. JP2015-124567 filed Jun. 22, 2015, the disclosure of which is hereby incorporated by reference herein in its entirety.

BACKGROUND OF THE INVENTION

Field of the Invention

The present invention relates to a microphone device and a microphone stand.

Description of the Related Art

A gooseneck microphone is provided as microphones for conference use which are set on, for example, a speech platform and a table for a conference participant in a conference hall, respectively.

The gooseneck microphone includes a long neck microphone pole portion having a flexible pipe whose angle and height can be easily adjusted. To a distal end portion of the microphone pole portion, a microphone case accommodating a microphone unit is fixed.

Additionally, a gooseneck microphone includes a circular latch lock connector being provided on a connector case as an outer enclosure which is a base end portion of the microphone pole portion. The circular latch lock connector (hereinafter, referred to also as an output connector) is defined as JEITA [Japan Electronics and Information Technology Industries Association] RC-5236.

Then, the gooseneck microphone on the desk via the microphone stand is set by connecting the output connector to a receptacle of a microphone stand placed, for example, on a desk.

Additionally, as a microphone unit of a gooseneck microphone, a small-sized and light-weight condenser microphone is used. For operating an impedance converter of the condenser microphone, a phantom power feeding system is adopted which is capable of obtaining an external electric power, and the phantom power supply supplies the external electric power to the microphone unit via the receptacle of the microphone stand and the output connector.

In other words, the output connector and the receptacle are used for transmission of an audio signal from the microphone unit and also as a supply path for a phantom power.

FIG. 1 shows an external configuration of one example of the above-described gooseneck microphone. This gooseneck microphone (hereinafter, referred to also as a microphone body) 1 is configured with a microphone case 2 internally provided with a microphone unit not shown and the like, a first flexible pipe 3, a relay pipe 4, a joint member 5, a second flexible pipe 6, and a connector case 7 which are connected sequentially.

Specifically, the microphone body 1 is constituted of the microphone case 2 as an upper end portion, the connector case 7 as a base end portion, and a microphone pole portion which is formed of an intermediate portion therebetween including a flexible pipe.

Then, for each of the above-described respective members configuring the gooseneck microphone, a metallic conductive material is used and in particular, the inside of the microphone case 2 housing the microphone unit is configured so as to be electromagnetically shielded using the metallic conductive material.

Additionally, the microphone unit in the above-described microphone case 2 and the output connector accommodated in the connector case 7 are connected via a microphone cable (not shown) inserted through the above-described respective members configuring the microphone body 1.

FIG. 2 shows a state where the microphone body 1 illustrated in FIG. 1 is attached to a microphone stand 11. The microphone stand 11 includes a flat base casing 12, a receptacle 13 including a latch release lever 14 fixed to an upper surface of the base casing 12, a loud speaker 15 arranged so as to be opposed to the upper surface of the base casing 12, and a second receptacle 16 fixed so as to be opposed to a back of the base casing 12.

Connection is made between the receptacle 13 and the second receptacle 16 by a lead wire not shown in the base casing 12. Additionally, a plug 17 is inserted into the second receptacle 16. Through a microphone cord connected to the plug 17, the microphone body 1 is connected to a microphone amplifier unit such as a mixer including a phantom power supply.

Then, attaching the connector case 7 on the side of the microphone body 1 to the receptacle 13 fixed to the base casing 12 establishes erection of the microphone body 1 with the microphone stand 11. Simultaneously, each terminal pin of the output connector (not shown) in the connector case 7 is electrically conducted with each connection terminal to be described later, arranged in the receptacle 13.

FIG. 5A shows a conventional example of a state where the connector case 7 of the above-described microphone body 1 is attached to the receptacle 13 on the side of the microphone stand 11. In FIG. 5A, illustration of the output connector in the connector case 7 is omitted.

Additionally, FIG. 5B shows a first configuration example of a conventional receptacle 13, and FIG. 5C shows a second configuration example of the same receptacle 13.

The receptacle 13 shown in FIG. 5B and FIG. 5C includes a pin receiving portion 21 on a central area of an upper surface thereof and a circular connector supporting groove 22 surrounding the pin receiving portion 21 is formed. On a side surface of the pin receiving portion 21 in the connector supporting grove 22, a latch claw 23 is arranged to protrude which can be engaged with a latch hole 7*a* formed on the connector case 7 on the side of the microphone 1 (see FIG. 5A). By pressing the above-described latch release lever 14, the latch claw 23 can be pulled back into the pin receiving portion 21. This enables the connector case 7 to be detachable from the receptacle 13 in an axis direction.

In the receptacle 13, connection terminals 24 to 26 are arranged to protrude from a lower bottom surface. Each of the terminals are assigned to a first terminal 24 for grounding, a second terminal 25 for a signal hot side, and a third terminal 26 for a signal cold side, respectively. Connector pins, to be described later, which are arranged in the output connector on the base side of the microphone body 1, are inserted into and connected to the connection terminals 24 to 26.

Then, in the first mode of the receptacle 13 illustrated in FIG. 5B, a spring-like contact 27 which comes into contact conduction with the connector case 7 is arranged in the connector supporting groove 22. In the example shown in FIG. 5B, the spring-like contact 27 is connected to the first terminal 24 for grounding.

Specifically, when the connector case 7 is attached, each member of the microphone body 1 illustrated in FIG. 1 is grounded via the spring-like contact 27.

On the other hand, the second mode of the receptacle 13 illustrated in FIG. 5C is suitably used for connection of a microphone body 1 having a configuration in which an LED, for example, is mounted on the microphone body 1 and the LED turns on when the microphone body 1 is in an ON state where an audio signal from the microphone body 1 is ready to be taken.

Therefore, although the receptacle 13 illustrated in FIG. 5C uses the similar spring-like contact 27 as the example illustrated in FIG. 5B, this spring-like contact 27 is connected to a non-illustrated frame terminal other than the above-described first to third terminals 24 to 26 of the connection terminals.

In this case, such means is adopted as uses the first pin of the output connector for on and off control of the LED, and the second and third pins, and the frame terminal for transmission of an audio signal from the microphone unit and feeding of the above-described phantom power supply.

Accordingly, when the above-described connection configuration is adopted, the spring-like contact 27 of the receptacle 13 illustrated in FIG. 5C is a sole connection path of grounding line between the connection microphone body 1 and a microphone amplifier unit such as a mixer.

In the receptacle 13 illustrated in FIG. 5B and FIG. 5C, a small gap is formed between an inner circumferential surface of the connector supporting groove 22 and an inner circumferential surface of the connector case 7 on the side of the microphone body 1 for facilitating attachment and detachment of the connector case 7. Then, the gooseneck microphone (microphone body) 1 and the microphone stand 11 are attached by engaging the latch hole 7*a* with the latch claw 23 as illustrated in FIG. 5A.

Accordingly, the above-described gap between the connector supporting groove 22 and the connector case 7 illustrated in FIG. 5A causes rattling of the microphone body 1 on the microphone stand 11.

When a desk on which the microphone stand 11 is placed shakes, this rattling propagates to the microphone case 2 through the microphone pole portion of the microphone and as a result generates a vibration noise. Additionally, as illustrated in FIG. 2, in a conference system in which a loud speaker 15 is mounted in the microphone stand 11, vibration due to sound waves emitted from the loud speaker 15, in particular, low-frequency vibration propagates. This vibration causes the microphone body 1 to shake involving the rattling, thereby generating a vibration noise.

Further, since a sound collecting axis of the gooseneck microphone 1 illustrated in the FIG. 2 is directed to a speaker, vibration caused by the above-described rattling is large in a direction perpendicular to the axis of the microphone, i.e., the microphone shakes to a large extent as illustrated in a virtual line in FIG. 2.

On the other hand, in addition to the problem of noise generated by vibration of the above-described microphone, rattling of the microphone body 1 on the microphone stand 11 affects electrical connection in the receptacle 13 including the spring-like contact 27 illustrated in FIG. 5C.

Specifically, when a failure of electrical conduction of the spring-like contact 27 with the connector case 7 is caused due to the rattling, a sole grounding line linking the microphone body 1 and the microphone amplifier unit such as a mixer is disconnected. Accordingly, in a conventional connection means between the connector case and the receptacle, grounding becomes unstable and may cause to invite a problem of a loud noise.

It has been so far proposed to suppress generation of a noise by preventing rattling of a gooseneck microphone on a microphone stand, which is disclosed, for example, in Japanese Patent No. 4686410 B1 (hereinafter referred as Patent Document 1).

SUMMARY OF THE INVENTION

The microphone connection disclosed in JP 4686410 B1 is realized by screw-fastening a receptacle to a base casing of a microphone stand with a gasket made of a rubber material.

Accordingly, even when the receptacle is screw-fastened using the above-described gasket, as already described with reference to FIG. 5A, rattling of the microphone body 1 due to the above-described gap generated between the connector supporting groove 22 and the connector case 7 is not eliminated.

The present invention is made in view of the technical problems of the prior art, and an object of the present invention is to provide a microphone device and a microphone stand enabling to effectively reduce rattling which is caused by the above-described gap formed between a connector supporting groove on the side of a receptacle and a connector case on the side of a microphone, thereby suppressing generation of the above-described noise due to shaking of the microphone.

A microphone device according to this invention made to solve the above-described problem includes a microphone stand which has a connector supporting groove, and a microphone body supported by the microphone stand by inserting a connector case into the connector supporting groove, the microphone device being interposed between the microphone body and the microphone stand, in which the microphone body and the microphone stand are provided with a connection pin and a connection terminal which electrically connect the microphone body and the microphone stand, and a resilient conductive cloth which comes into contact with the connector case is arranged in the connector supporting groove, with the connector case being inserted in the connector supporting groove.

In this case, the conductive cloth is preferably arranged in a ring shape along a lower bottom portion of the annularly formed connector supporting groove. The microphone device is desirably configured such that an entire upper surface of the conductive cloth arranged in a ring shape comes into contact with an annularly formed opening portion of the connector case.

Additionally, in a preferred mode, in the connector supporting groove, a spring-like contact which comes into contact with a part of the conductive cloth is arranged, so that an electrical conduction path is formed from the connector case via the conductive cloth and the spring-like contact.

In addition, a configuration is adopted in which the connector case is formed with a latch hole engageable with a latch claw provided in the connector supporting groove, and the conductive cloth in the connector supporting groove is arranged further below the latch claw.

According to the present invention, the microphone body further includes a microphone shaft portion which connects a microphone case accommodating a microphone unit with the connector case. Then, a configuration is adopted in which between the microphone body and the microphone stand a microphone connection device is interposed.

Such a configuration is suitably adopted, in particular, for a microphone including a bendable flexible pipe provided in a microphone shaft portion (gooseneck microphone).

In the above-described microphone device and microphone stand according to this invention, inserting a connector case on the side of a microphone body into a connector supporting groove of the microphone stand results in supporting the microphone body so as to be attachable and detachable to/from the microphone stand. In this case, in the connector supporting groove, a resilient conductive cloth contacting the connector case is arranged, so that this conductive cloth comes into contact with the connector case to suppress the above-described rattling, thereby effectively suppressing fluctuation of the microphone body.

Additionally, in the connector supporting grove, arranging a spring-like contact coming into contact with a part of the conductive cloth enables the connector case to electrically conduct with the spring-like contact via the conductive cloth. Accordingly, even when the connector case does not come into direct contact with the spring-like contact, reliable electrical connection can be ensured via the conductive cloth.

This configuration allows to eliminate a loud noise generated due to disconnection of a ground line between the above-described microphone body and a microphone amplifier unit such as a mixer.

DESCRIPTION OF THE PREFERRED EMBODIMENTS

An embodiment of a microphone device and a microphone stand according to the present invention will be described in detail with reference to the drawings.

Figure 1:
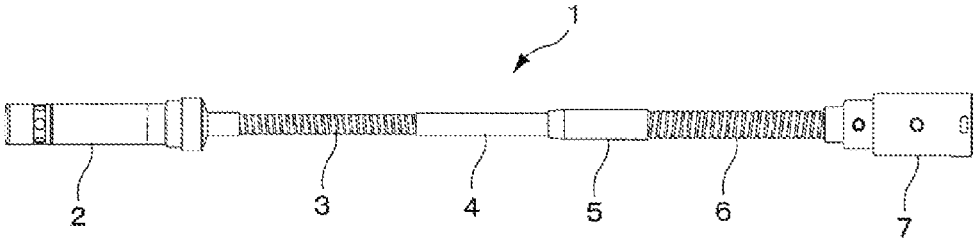
FIG. 1 is an external view showing one example of a gooseneck microphone which can be adopted by the present invention and a conventional microphone device.

FIG. 1 shows one example of a conventional gooseneck microphone, also showing a configuration of a gooseneck microphone (microphone body) that can be used in the present invention. Additionally, FIG. 2 similarly shows one example of a conventional microphone stand, also showing a configuration of a microphone stand that can be used in the present invention.

Figure 2:
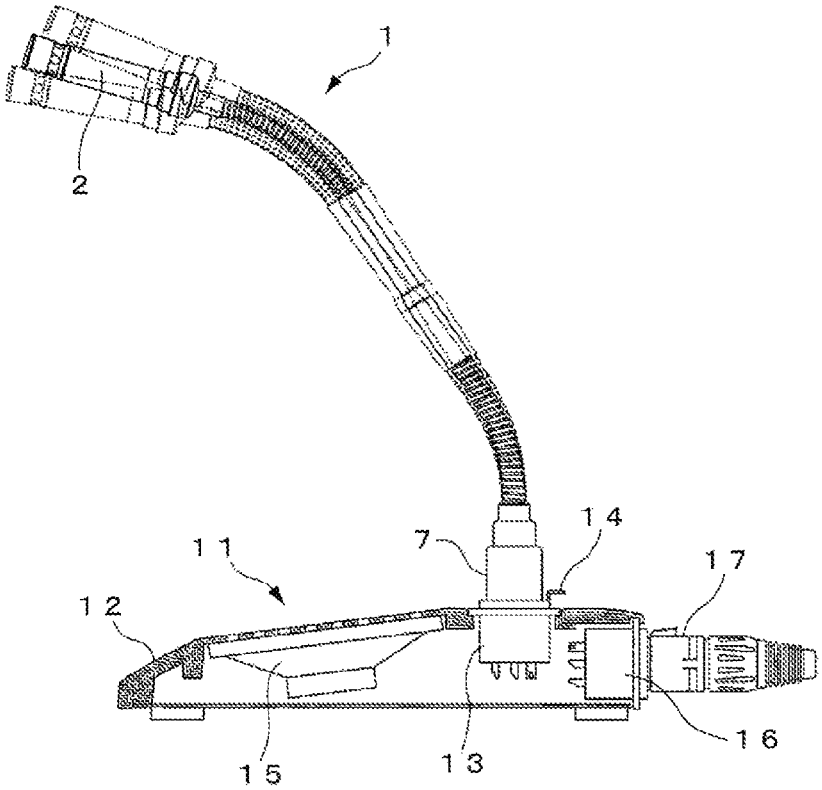
FIG. 2 is a partial sectional view showing a state where the gooseneck microphone shown in FIG. 1 is attached to a microphone stand.

Since the configurations shown in FIG. 1 and FIG. 2 have been already described, the overlapped description will not be repeated.

Figure 3A:
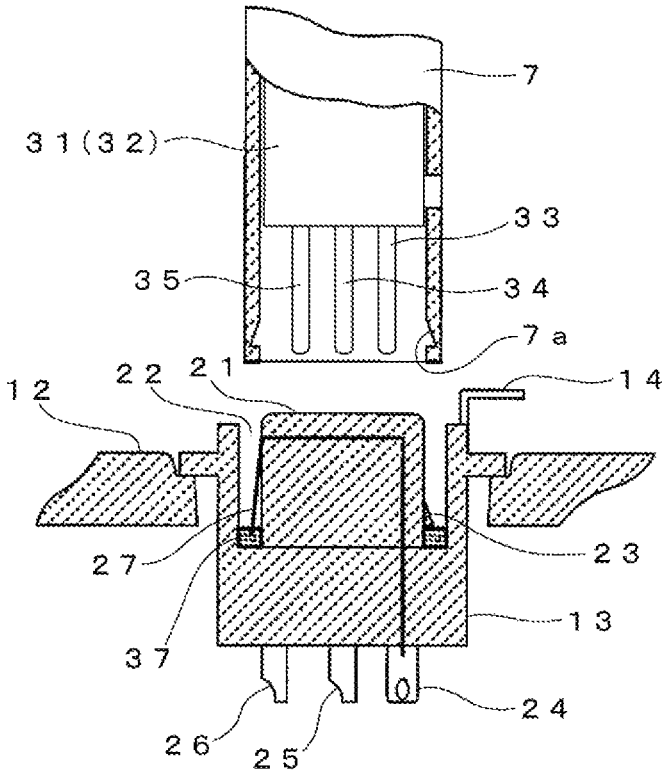
FIG. 3A is a sectional view showing a non-connection state of a first mode of a microphone device according to the present invention.
Figure 3B:
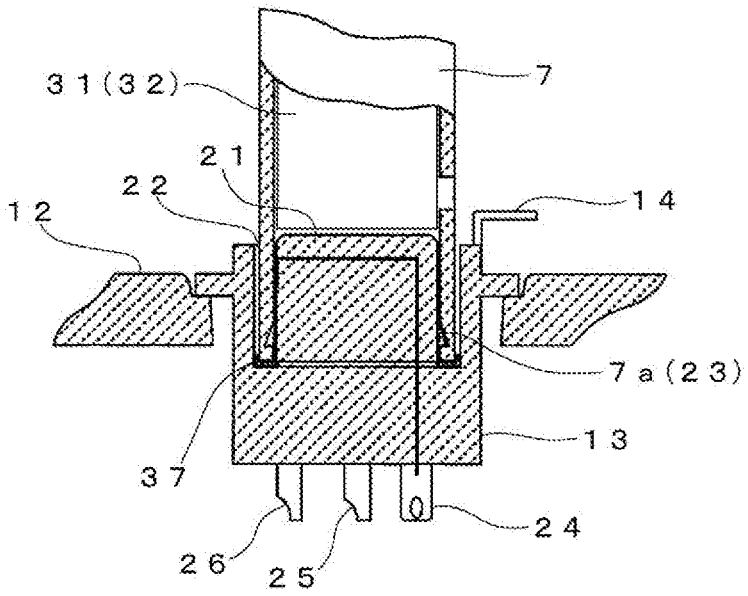
FIG. 3B is a sectional view showing a connection state of the mode of the microphone device according to the present invention.

FIG. 3A and FIG. 3B show a first mode of a microphone device according to the present invention which is interposed between the microphone body 1 and the microphone stand 11 illustrated in FIG. 1 and FIG. 2.

FIG. 3A shows a state where the connector case 7 of the microphone body 1 is opposed to the receptacle 13 on the microphone stand 11. An output connector 31 is configured with the connector case 7 as an outer shell.

The output connector 31 includes a connector base 32 formed of an insulating resin and to be fit into the connector case 7. To the connector base 32, three connector pins 33 to 35 are attached in the connector case 7 along an axis direction of the case 7. The three connector pins 33 to 35 are assigned to a first pin for grounding, a second pin for a hot side of a signal, and a third pin for a cold side of a signal, respectively.

Additionally, a pin receiving portion 21 is provided at a central area of an upper surface of the receptacle 13 attached on an upper surface of the base casing 12 as illustrated in FIG. 2. Then, a circularly recessed connector supporting groove 22 is formed around the pin receiving portion 21.

On an inner circumferential surface of the pin receiving portion 21 in the connector supporting groove 22, a latch claw 23 is arranged to protrude which is engageable with a latch hole 7*a* formed on an inner circumferential surface of the connector case 7 of the microphone body 1. This latch claw 23 is pulled back into the pin receiving portion 21 as a result of pushing of the latch release lever 14 that the receptacle 13 includes.

At a lower bottom portion of the above-described circularly recessed connector supporting groove 22, a resilient conductive cloth 37 is placed in a ring shape manner along the lower bottom portion. The conductive cloth 37 is arranged such that an upper surface of the conductive cloth 37 is located far below the latch claw 23.

As the resilient conductive cloth 37, for example, conductive fine wires made of stainless steel which are woven and formed into a cloth, or strips obtained by cutting nonwoven fabric of stainless steel.

For such conductive cloth 37, for example, a conductive cloth "SUI-78-5010T" manufactured by Taiyo Wire Cloth Co., Ltd. can be used.

Then, when arranging the conductive cloth 37 in the lower bottom portion of the circularly recessed connector supporting groove 22, applying an adhesive to the bottom portion of the connector supporting groove 22, or to a lower bottom surface of the conductive cloth 37 to attach the conductive cloth 37 prevents the conduction cloth from coming off.

The receptacle 13 has connection terminals 24 to 26 arranged to protrude from its lower bottom surface. As illustrated in FIG. 3B, connector pins 33 to 35 are inserted into and connected to these connection terminals 24 to 26 from above the output connector 31 placed on the connector case 7.

Accordingly, in this embodiment, the respective connection terminals 24 to 26 serve as a first terminal for grounding, a second terminal for a hot of a signal and a third terminal for cold of a signal, respectively.

Additionally, in the connector supporting groove 22, a spring-like contact 27 having a tip end portion which comes into contact with a part of the conductive cloth 37 is provided and is connected to the first terminal 24 for grounding.

In the configuration illustrated in FIG. 3A, when the connector case 7 of the microphone 1 is inserted into the connector supporting groove 22 of the receptacle 13, a circularly formed opening portion at a tip of the connector case 7 comes into contact first with the entire upper surface of the conductive cloth 37 placed in a ring shape manner in the connector supporting groove 22. When the connector case 7 is further pushed in this state, the conductive cloth 37 is compressed by the opening portion of the connector case 7. The latch claw 23 fits in the latch hole 7*a* formed in the connector case 7.

As illustrated in FIG. 3B, this brings the connector case 7 to be retained and locked in the receptacle 13, so that the microphone body 1 is attached to the microphone stand 11.

On this occasion, the above-described spring-like contact 27 comes into contact with an inner circumferential surface of the connector case 7, while an electrical conduction path is formed from the connector case 7 to the first terminal 24 for grounding via the conductive cloth 37 and the spring-like contact 27. Accordingly, each member on the microphone body 1 illustrated in FIG. 1 is connected to ground.

In the state as illustrated in FIG. 3B, the latch claw 23 is pulled back into the pin receiving portion 21 as a result of pushing of the latch release lever 14. As illustrated in FIG. 3A, this brings the connector case 7 to be detachable from the receptacle 13 in the axis direction.

According to the first mode of the microphone device illustrated in FIG. 3A and FIG. 3B, in the connector supporting groove 22 formed in the receptacle 13, the resilient conductive cloth 37 which comes into contact with the connector case 7 is arranged. Accordingly, this conductive cloth 37 effectively suppresses rattling caused by a gap between the connector supporting groove 22 and the connector case 7.

Accordingly, shaking of the microphone body 1 attached to the microphone stand 11 can be suppressed and generation of a vibration noise can be also suppressed. Additionally, the above-described electrical conduction path is also formed from the connector case 7 to the first terminal 24 for grounding via the conductive cloth 37 and the spring-like contact 27, which ensures reliable ground connection of the microphone body 1.

Figure 4A:
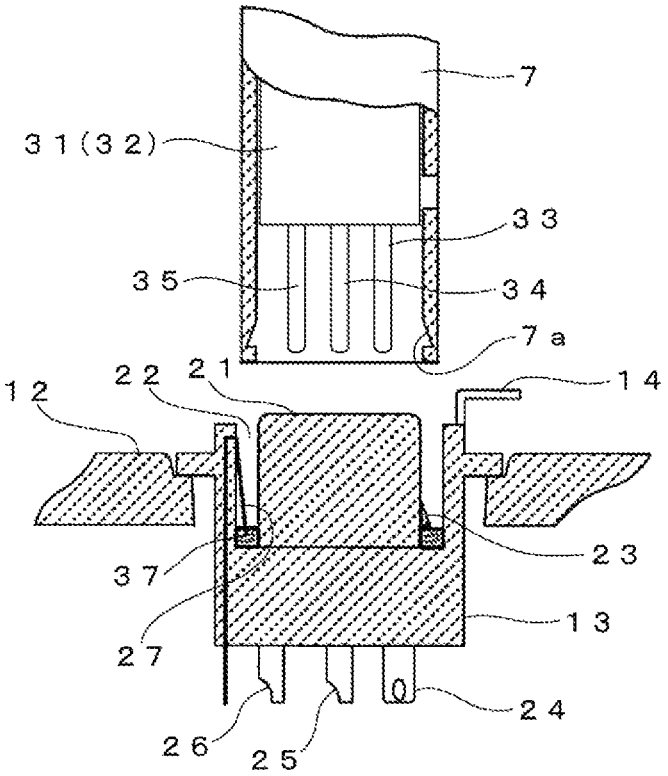
FIG. 4A is a sectional view showing a non-connection state of a second mode of the microphone device according to the present invention.
Figure 4B:
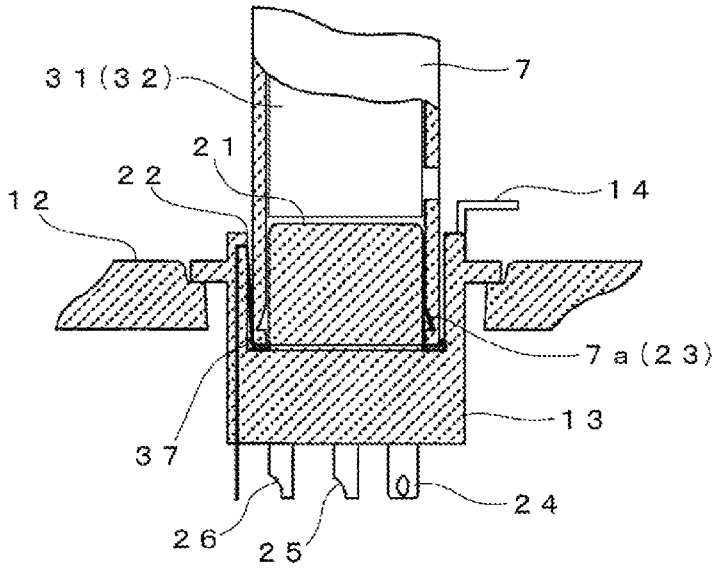
FIG. 4B is a sectional view showing a connection state of the second mode of the microphone device according to the present invention.

Next, FIG. 4A and FIG. 4B illustrate a second mode of the microphone connection device according to the present invention interposed between the microphone body 1 and the microphone stand 11 illustrated in FIG. 1 and FIG. 2. Since main parts of the second mode are the same as those of the first mode illustrated in FIG. 4A and FIG. 4B, the previously described components are identified by the same reference numerals and the detailed description of the components are omitted.

Figure 5A:
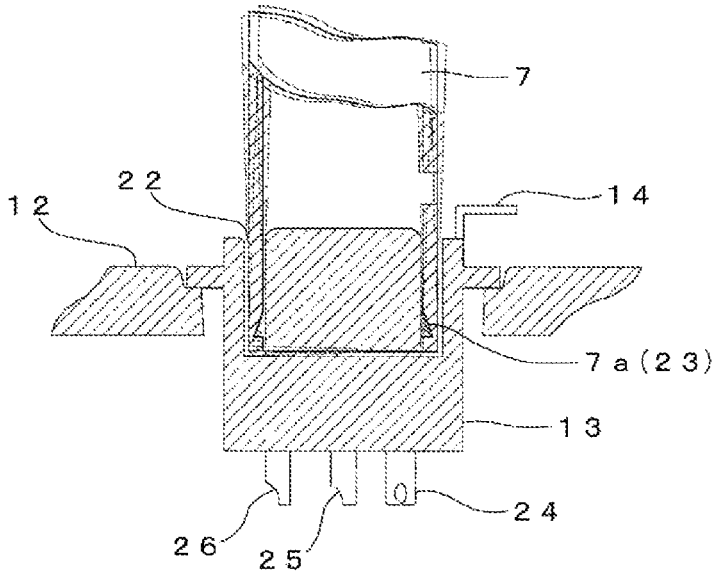
Fig. 5A Prior Art
FIG. 5A is a sectional view for explaining a function of a conventional microphone device.
Figure 5B:
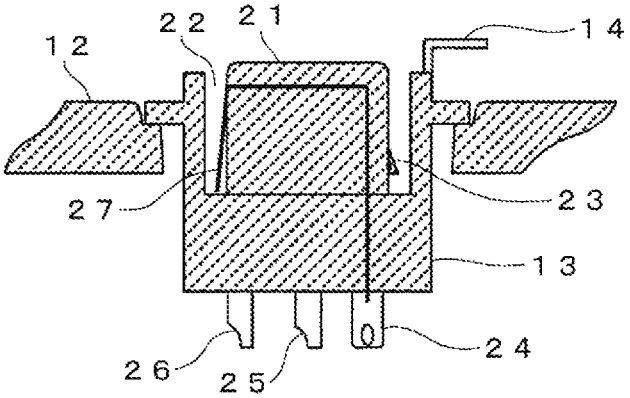
Fig. 5B Prior Art
FIG. 5B is a sectional view showing a first example of a receptacle which configures the conventional microphone device.
Figure 5C:
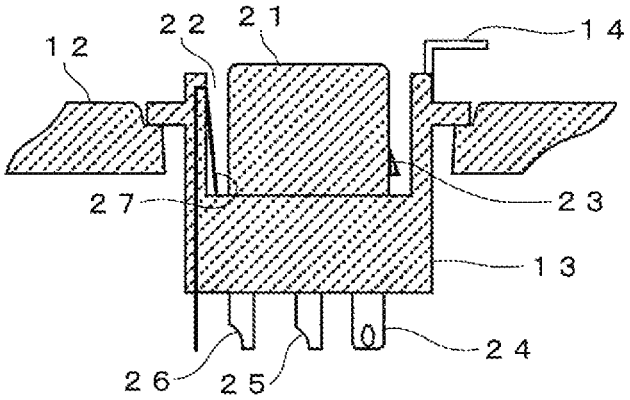
Fig. 5C Prior Art
FIG. 5C is a sectional view showing a second example of the same receptacle.

In the second mode, one end portion of a spring-like contact 27 arranged in a connector supporting groove 22 comes in contact with a part of a conductive cloth 37 in an internal bottom portion of the connector supporting groove 22, and the other end portion of the spring-like contact 27 is connected to a frame terminal (not shown), similarly in the case of the example illustrated in FIG. 5C.

Specifically, the second mode is used for connection of the microphone body 1 having an LED, for example, as has been already described with reference to FIG. 5C. In such a configuration, for example, turning on the LED notifies that the microphone becomes in an on-state where an audio signal from the microphone body can be captured.

In this configuration, a first pin 33 of an output connector is used for on and off control of the LED, and a second pin 34, a third pin 35, and the frame terminal of the output connector are used for transmission of an audio signal from the microphone unit and supply of the above-described phantom power.

The remaining configuration of the second mode illustrated in FIG. 4A and FIG. 4B is the same as that of the first mode illustrated in FIG. 3A and FIG. 3B and accordingly, its function and effect are similar to those of the above-described first mode. In addition, according to the second mode, in the state illustrated in FIG. 4B where the connector case 7 is attached to the receptacle 13, a conduction path is formed from the connector case 7 to a frame terminal (not shown) via the conductive cloth 37 and the spring-like contact 27.

Accordingly, even when contact between the connector case 7 and the spring-like contact 27 fails, reliable electrical connection can be ensured via the conductive cloth 37.

This solves a problem of a loud noise generated due to disconnection of a ground line between the side of the above-described microphone body 1 and a microphone amplifier unit such as a mixer.

The foregoing described embodiments are examples in which a gooseneck microphone is attached to a microphone stand so as to be attachable or detachable thereto/therefrom. The microphone device according to the present invention is applicable not only to a gooseneck microphone but also to other type of microphone body.

Additionally, with respect to the example shown in FIG. 4A and FIG. 4B, the description has been made of the function obtained by using the conductive cloth in the connection device for the microphone body having an LED. The present invention, however, is not limited to connection of a microphone body having an LED, but can be certainly used for a microphone device of another mode.

What is claimed is:

1. A microphone device comprising:

a microphone stand having an annular connector supporting groove;

a microphone body including a connector case inserted into the connector supporting groove so that the microphone body is supported by the microphone stand, the connector case having an annular opening portion at a tip of the connector case;

a spring contact arranged in the connector supporting groove; and a conductive cloth arranged in a ring shape along a bottom portion of the connector supporting groove and resiliently contacting the spring contact, wherein when the connector case is inserted into the connector supporting groove of the microphone stand, an entire upper surface of the conductive cloth resiliently contacts the opening portion of the connector case so that an electrical conduction path is configured to be formed from the connector case to the microphone stand through the conductive cloth and the spring contact.

2. The microphone device according to claim 1, wherein the connector case is formed with a latch hole engageable with a latch claw provided in the connector supporting groove, and the conductive cloth in the connector supporting groove is arranged further below the latch claw.

3. The microphone device according to claim 1, wherein the microphone body further includes a microphone pole portion which connects a microphone case accommodating a microphone unit with the connector case.

4. The microphone device according to claim 3, wherein the microphone pole portion includes a bendable flexible pipe.

5. A microphone stand into which a microphone body including a connector case is inserted, the microphone stand comprising:

a connector supporting groove adapted to support the microphone body;

a spring contact arranged in the connector supporting groove; and a conductive cloth arranged in the connector supporting groove and resiliently contacting the spring contact, wherein when the connector supporting groove receives the connector case of the microphone body, the conductive cloth resiliently contacts the connector case so that the conductive cloth electrically connects the connector case and the spring contact to form an electrical conduction path.

6. The microphone stand according to claim 5, wherein the connector supporting groove is further provided with a latch claw, and the conductive cloth in the connector supporting groove is arranged far below the latch claw.

7. The microphone device according to claim 1, wherein the microphone stand further includes a latch claw inside the connector supporting groove, and the connector case further includes a latch hole to engage the latch claw so that when the connector case is inserted into the connector supporting groove, the latch claw engages the latch hole while the conductive cloth resiliently contacts the opening portion.

8. The microphone device according to claim 7, wherein the conductive cloth includes conductive wires made of stainless steel.

9. The microphone stand according to claim 5, further comprising a latch claw inside the connector supporting groove, wherein when the connector supporting groove receives the connector case, the latch claw engages the connector case while the conductive cloth is adapted to resiliently contact the connector case.

10. The microphone stand according to claim 9, wherein the conductive cloth includes conductive wires made of stainless steel.

* * * * *